US011786051B2

(12) United States Patent
Andrew

(10) Patent No.: US 11,786,051 B2
(45) Date of Patent: Oct. 17, 2023

(54) MULTI-LAYERED SEGMENT MATTRESS

(71) Applicant: Carleton Andrew, Palm Coast, FL (US)

(72) Inventor: Carleton Andrew, Palm Coast, FL (US)

( * ) Notice: Subject to any disclaimer, the term of this patent is extended or adjusted under 35 U.S.C. 154(b) by 320 days.

(21) Appl. No.: 16/025,110

(22) Filed: Jul. 2, 2018

(65) Prior Publication Data

US 2020/0000243 A1 Jan. 2, 2020

(51) Int. Cl.
*A47C 27/05* (2006.01)
*A47C 27/00* (2006.01)
*A47C 27/14* (2006.01)

(52) U.S. Cl.
CPC ..... *A47C 27/05* (2013.01); *A47C 27/001* (2013.01); *A47C 27/148* (2013.01)

(58) Field of Classification Search
CPC ..... A47C 27/14; A47C 27/144; A47C 27/146; A47C 27/148; A47C 27/15; A47C 27/20; A47C 27/22; A47C 27/001; A47C 27/05; A47C 27/056; A47C 27/064
See application file for complete search history.

(56) References Cited

U.S. PATENT DOCUMENTS 3,027,573 A * 4/1962 Bell, Jr. ..... A47C 27/22 5/738
4,706,313 A * 11/1987 Murphy ..... A47C 27/148 5/722
6,101,653 A * 8/2000 England ..... A47C 27/001 5/727
6,212,720 B1 * 4/2001 Antinori ..... A47C 27/086 5/716
7,036,172 B2 * 5/2006 Torbet ..... A47C 27/082 5/713
7,386,903 B2 * 6/2008 Hochschild ..... A47C 31/105 5/691
9,913,538 B2 * 3/2018 Andreotti ..... A47C 27/064
2007/0022540 A1 * 2/2007 Hochschild ..... A47C 27/001 5/738
2017/0325596 A1 * 11/2017 Torbet ..... A47C 27/18
2019/0090651 A1 * 3/2019 Gargalis ..... A47C 31/001

FOREIGN PATENT DOCUMENTS

WO WO-2011156891 A1 * 12/2011 ..... A47C 21/048

* cited by examiner

*Primary Examiner* — David R Hare
*Assistant Examiner* — Amanda L Bailey
(74) *Attorney, Agent, or Firm* — Arenstein & Andersen; Christen Shore

(57) ABSTRACT

A mattress embodying a removable exterior top and interchangeable segments (e.g. foam) positioned above a mattress base support portion and below the removable exterior top. The removable exterior top may be replaced with new or different removable exterior tops. Also, users have the ability to vary softness (i.e., firmness) or other characteristics (e.g., foam component construct) across the mattress by arranging or rearranging the interchangeable segments located directly below the removable and interchangeable mattress top. An exemplary base support portion may include a heavy duty pocketed inner-coil unit for motion transfer support and increased airflow.

21 Claims, 5 Drawing Sheets

MULTI-LAYERED SEGMENT MATTRESS

BACKGROUND AND SUMMARY OF THE INVENTION

Exemplary embodiments of the present invention generally relate to mattresses. For example, one embodiment of a mattress may comprise a removable exterior top and at least one interchangeable segment. Exemplary embodiments may address one or more shortcomings of known mattresses.

Known mattresses consist of one or more upholstery layers, and generally involve a core support system. Known upholstery layers include layers of foam, the layers often being contained within a mattress casing. In known single-mattress bed designs, each layer of foam is continuous across a plane defined by the perimeter of the mattress. It is also known that mattress designs involving multiple layers of foam may provide additional user support or pressure relieving conformity.

Traditional mattress core support systems involve wire springs, but more contemporary designs often involve rows and columns of individual spring coils, which are commonly known as pocketed coils. One benefit of using pocketed coils is that each coil responds independently to pressure, allowing for user weight to be distributed across a smaller area of the bed. In other known mattress designs, the mattress core support system is limited to one or more layers of firm foam.

Because known mattress designs involve layers of foam which are continuous across a plane defined by the perimeter of the mattress, users do not have the ability to vary softness characteristics of the mattress at certain points across the area of the mattress. This may be an issue when multiple users using a single known mattress have different preferences in mattress softness or other characteristics, or an individual user has different mattress softness (and/or other characteristic) preferences with respect to different portions of that user's body. In addition, the permanent encasing of traditional mattresses makes it impossible for users to switch out the top portion of the mattress exterior in favor of another preferred mattress top. This may be an issue when a current mattress top of a known design suffers significant wear and tear, or one or more users decide that a different mattress top design would be preferable to the current mattress top design. The known art therefore has an unmet need to provide a mattress that has a removable exterior top and interchangeable segments below the exterior top which allow the user to vary the softness (i.e., firmness) or other characteristics of the mattress with respect to a specific area of the bed. Furthermore, there is an unmet need for a mattress including a removable exterior top and interchangeable segments below the exterior top to have exemplary core support, including the support of an inner coil unit or other support system.

Exemplary embodiments of the present invention may satisfy one or more those unmet needs. In particular, an exemplary embodiment of the present invention relates to a mattress having a removable and interchangeable exterior top, and interchangeable (e.g., foam) segments located below the exterior top. For example, a removable and interchangeable mattress top may provide a user access to at least one interchangeable (e.g., foam) segment portion of the mattress in order to arrange or rearrange the foam segment(s) in a multitude of configurations, creating a myriad of different user comfort feels. For instance, in an exemplary embodiment, users may have the ability to vary softness (i.e., firmness) or other characteristics (e.g., foam component construct) across the mattress with respect to at least one (e.g., foam) sections directly below a removable and interchangeable mattress top. This may be particularly beneficial when multiple users using the mattress have different preferences in mattress softness or other characteristics (e.g., foam component construct), or an individual user has different mattress softness or other characteristic (e.g., foam component construct) preferences with respect to different portions of that user's body.

In addition, an exemplary embodiment may comprise a removable and interchangeable mattress top that may be changed out over time or switched to new or different mattress top designs, which may offer a myriad of different comfort or health benefits. This may be particularly beneficial for when a current mattress top suffers significant wear and tear, or one or more users decide that a different mattress top design would be preferable to the current mattress top design. In certain exemplary embodiments, a removable and interchangeable mattress top may be a zipper cover. Other exemplary embodiments may comprise other mechanisms (e.g., buttons, snaps, hook and loop fasteners, etc.) to facilitate removal and/or interchanging of a mattress top.

An exemplary embodiment may further include an encasement layer designed to house the aforementioned segments. In an exemplary embodiment, an encasement layer may define the top of a base support portion of the mattress. An example of a base support portion may further include an inner coil unit (or another suitable support structure) positioned below the encasement layer and above a support layer (e.g., a foam support layer). In an exemplary embodiment, a base support portion may provide core support to the upper upholstery layers, including the segments and the mattress top.

These and other unmet advantages may be provided by a device and method as described and shown in more detail below. Furthermore, in addition to the novel features and advantages mentioned above, other benefits will be readily apparent from the following descriptions of the drawings and exemplary embodiments.

DETAILED DESCRIPTION OF EXEMPLARY EMBODIMENT(S)

Figure 1:
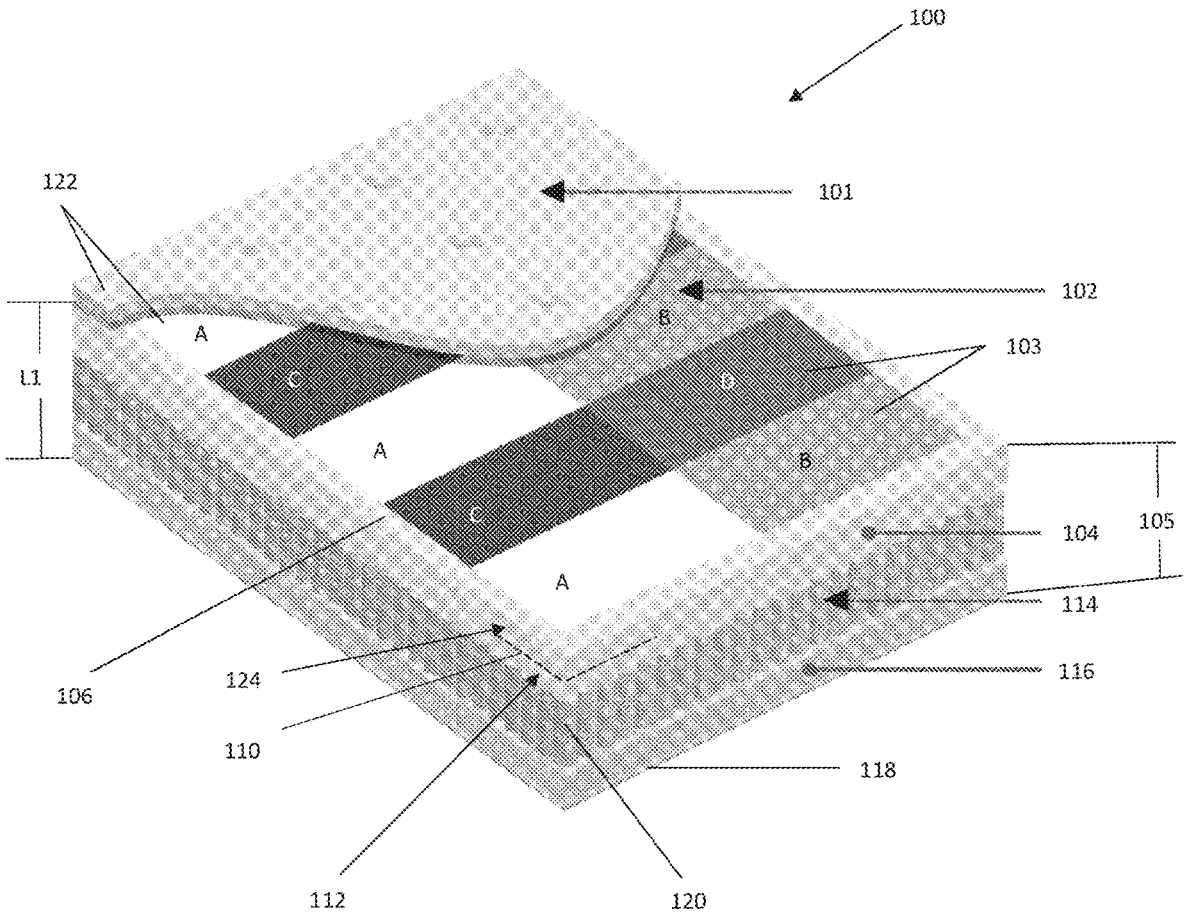
FIG. 1 is a perspective view of an exemplary embodiment of a mattress with a removable exterior top and interchangeable foam segments.

FIG. 1 shows, in perspective view, an exemplary embodiment of a mattress with a removable exterior top and interchangeable foam segments, wherein a portion of a mattress top is removed for clarity.

In the FIG. 1 embodiment, a section of a mattress top portion 101 (which may optionally be referred to as a comfort topper in some embodiments) is shown positioned directly above and substantially planarly parallel to posterior mattress layers L1 of a mattress 100. In certain exemplary embodiments, the mattress top portion 101 is a removable protective cover. In this embodiment, the removable protective cover of mattress top portion 101 may include at least one zipper to facilitate removal. For instance, such as in this example, a zipper may be configured for enclosing the removable protective cover of mattress top portion 101 over a different, larger, or entire surface area of mattress 100. In another exemplary embodiment, at least one zipper may be configured to connect a portion of the removable protective cover of mattress top portion 101 to another portion of the removable protective cover of mattress top portion 101 on the top side of mattress 100.

As shown in the exemplary embodiment of FIG. 1, the mattress top portion 101 may cover a top surface of an interchangeable segment portion 102 and a top surface 106 of extension walls 124 of an encasement layer 104. In exemplary embodiments, the removable mattress top portion 101 is interchangeable with new or different removable protective cover designs that may offer different comfort or health benefits (e.g., softness, flexibility, heat dispersing, or health improvement characteristics) and may be varied based on user preference. A removable mattress portion 101 may also be changed out over time for any other reason such as to address wear. Unique removable protective cover designs may further vary based on softness, flexibility, or other characteristics of the material comprising the removable protective cover. For example, without limitation, one exemplary embodiment of a mattress top portion 101 may be comprised of material to enhance comfort cooling characteristics. Another example of a mattress top portion 101 may be comprised of natural textural fibers or other specialty fibers (e.g., TENCEL™).

Figure 2:
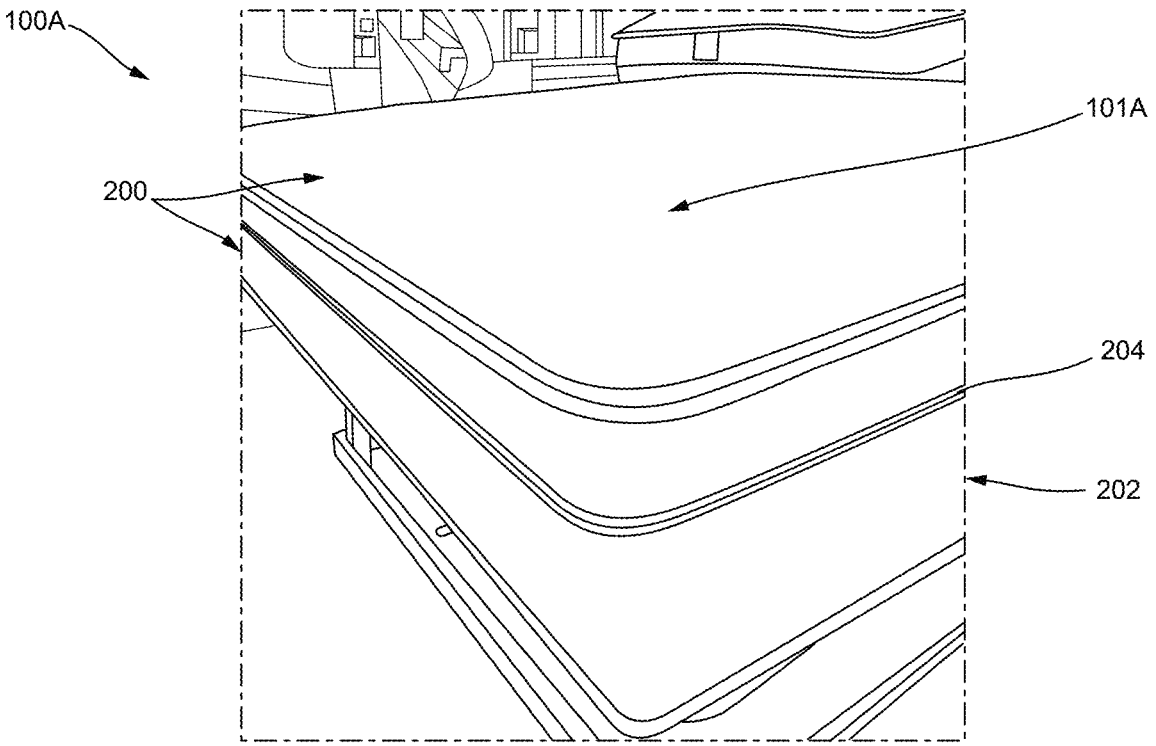
FIG. 2 is a perspective view of an exemplary removable and interchangeable mattress cover.
Figure 2A:
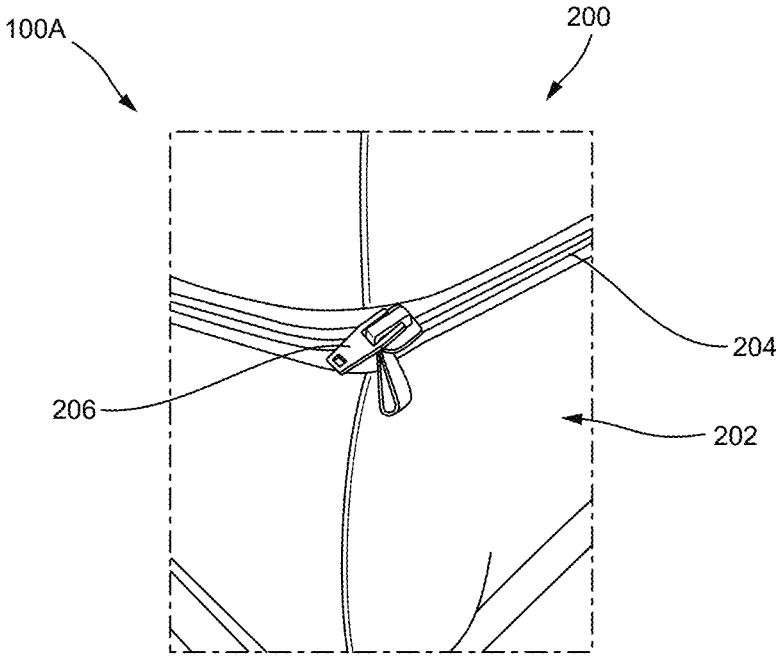
FIG. 2A is a detailed corner perspective view showing an exemplary zipper of the FIG. 2 embodiment.

FIG. 2 is a perspective view of an exemplary embodiment of a mattress 100A comprising a mattress top portion 101A where mattress top portion 101A is part of a removable and interchangeable mattress cover 200. In the FIG. 2 embodiment, mattress cover 200 fully encapsulates mattress 100A. Separate portions of the mattress cover 200 may be connected at an attachment zone 204 located on cover sides 202 of mattress cover 200. FIG. 2A further illustrates the FIG. 2 embodiment of mattress 100A having a zipper 206 configured to attach or disconnect separate portions of the mattress cover 200 at the attachment zone 204 on the cover sides 202 to facilitate removal of mattress top portion 101A. In some exemplary embodiments, removal may only require sufficient movement of the mattress top portion to expose a desired portion of the interchangeable segments and may not require complete separation of the mattress top portion from the mattress.

FIG. 1 further illustrates the interchangeable segment portion 102 having segments 103 (e.g., foam segments). In an exemplary embodiment of the present invention, one or more foam segments 103 may be varied with respect to other foam segments based on foam softness (i.e., firmness) or other characteristics (e.g., foam component construct). In the example of FIG. 1, four different types of foam segments 103 are included in mattress 100, where each foam segment 103 is identified by a letter which corresponds to a softness class, namely A, B, C or D. In this example, the class of foam segment 103 defines how soft that segment is relative to other segments (e.g., extra firm, firm, medium, and soft).

In an exemplary embodiment, users have the ability to access the interchangeable foam segment portion 102 of the mattress 100 by removing mattress top portion 101. Users may arrange or rearrange the foam segments 103 in a multitude of configurations, creating a myriad of different user comfort feels. Specifically, the interchangeable segment portion 102 co-acts with the mattress top portion 101 to provide users with the ability to vary softness (i.e., firmness) or other characteristics at different locations of mattress 100. In an exemplary embodiment, this is particularly beneficial when multiple users of the mattress 100 have different preferences in mattress softness (i.e., firmness) or other characteristics (e.g., foam component construct), or an individual user has different mattress softness (i.e., firmness) or other characteristic (e.g., foam component construct) preferences with respect to different portions of that user's body.

In the embodiment shown in FIG. 1, the foam segments 103 are rectangles designed for arrangement below the mattress top portion 101 and substantially above and/or over a base support portion 105. The foam segments 103 are positioned in five rows by two columns in this particular embodiment. In certain preferred embodiments, groups of five foam segments 103 may be included for each softness class. Other exemplary embodiments may include any desired number, shapes (e.g., square, polygonal, circular, random, etc.), and types of segments. Furthermore, relative to types, other exemplary embodiments of segments may be comprised of one or more other materials (e.g., down, polyester, feathers, cotton, wool, other synthetic materials, etc.) in addition to or in lieu foam. As a result, in an exemplary embodiment, a user may further select any desired combination of segments relative to number, shape, and/or type.

FIG. 1 further illustrates an embodiment where the encasement layer 104 defines an upper layer of the base support portion 105. The encasement layer 104 comprises a foundation 112, and extension walls 124 extending upward from the foundation 112. In some embodiments, such as the embodiment show in FIG. 1, the extension walls 124 extend upward from a perimeter 110 of the encasement layer 104. In some other exemplary embodiments, the extension walls may extend upward from any portion of a foundation to define a shape adapted to receive the interchangeable segments. The foam segments 103 are placed on top of the foundation 112, and the foundation 112 co-acts with the mattress top portion 101 to retain the foam segments 103. The extension walls 124 of encasement layer 104 act to horizontally retain the foam segments 103 relative to the foundation 112 and mattress top portion 101. In certain preferred embodiments, the encasement layer comprises coarse foam. In other exemplary embodiments, an encasement layer may be comprised of any other material suitable to encase or house segments 103.

Figure 3:
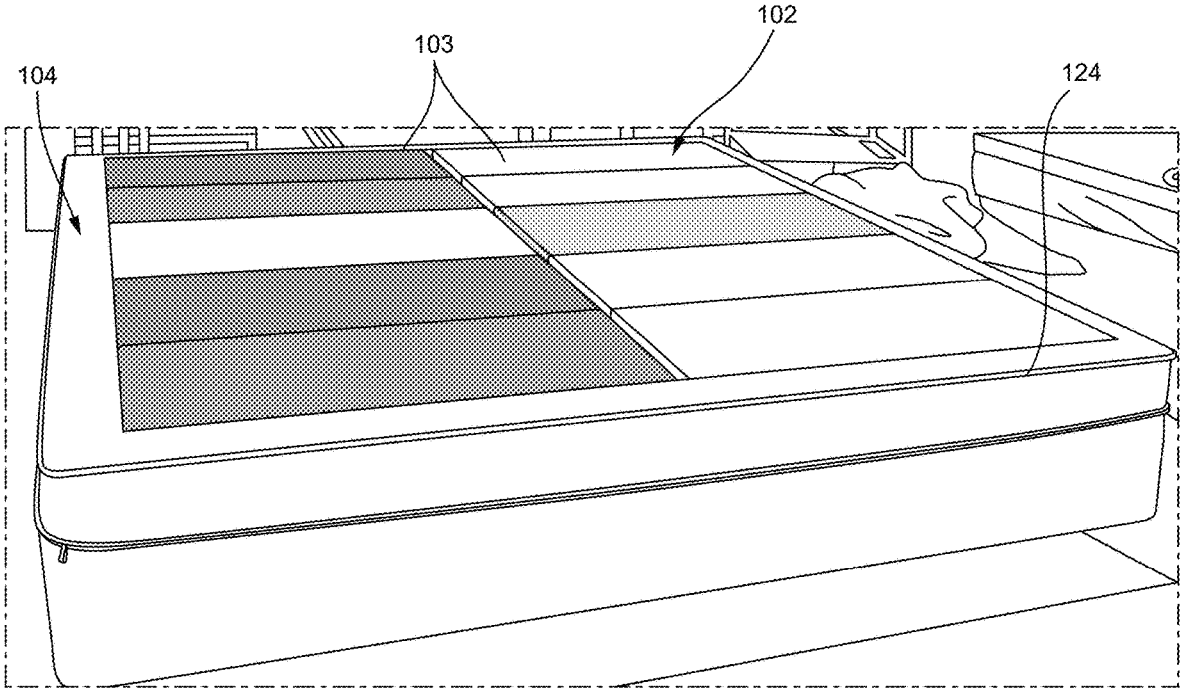
FIG. 3 is a perspective view of an exemplary embodiment of a mattress, wherein a mattress top portion has been removed for clarity. In this view, an exemplary interchangeable segment portion of the FIG. 1 embodiment is shown, where multiple rows and columns of foam segments are visible.
Figure 4:
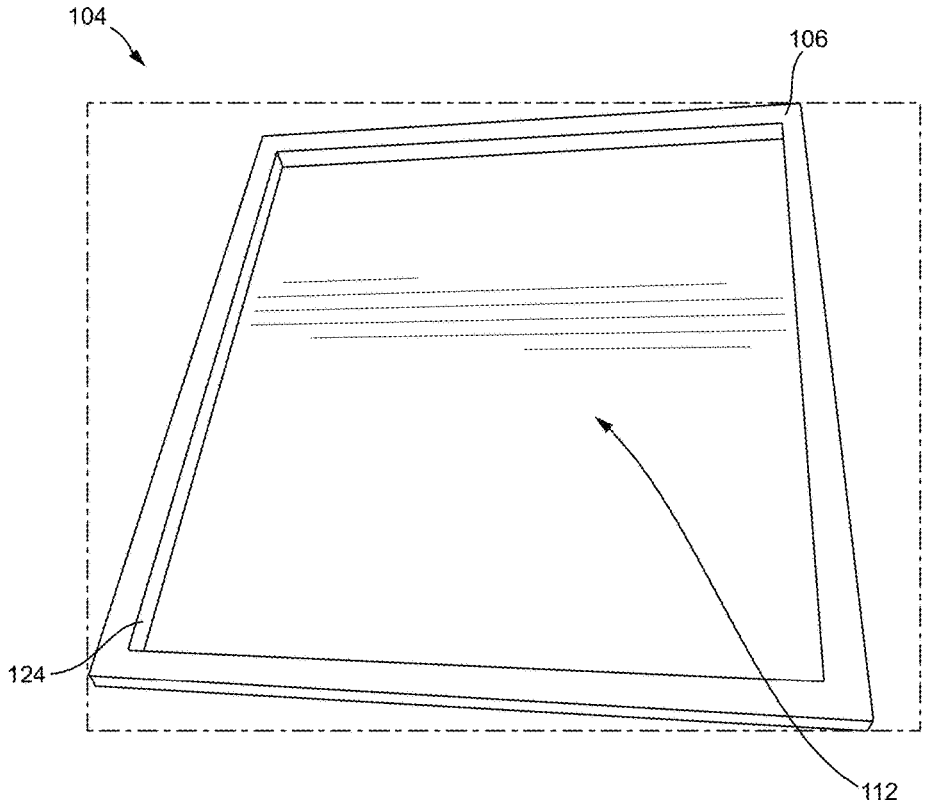
FIG. 4 is a top perspective view of an exemplary encasement layer of the FIG. 1 embodiment.

FIG. 3 is a perspective view of a mattress, wherein a mattress top portion has been removed for clarity. In this view, the interchangeable segment portion 102 of the FIG. 1 embodiment is visible, where multiple rows and columns of foam segments 103 are visible between the extension walls 124 of encasement layer 104. FIG. 4 is a top perspective view of an exemplary encasement layer 104 comprising foundation 112 and extension walls 124 with top surface 106 of the FIG. 1 embodiment. In some other exemplary embodiments, an encasement layer may be partially or totally open between the walls, in which case a bottom of a wall may still be considered a foundation for the wall.

Figure 5:
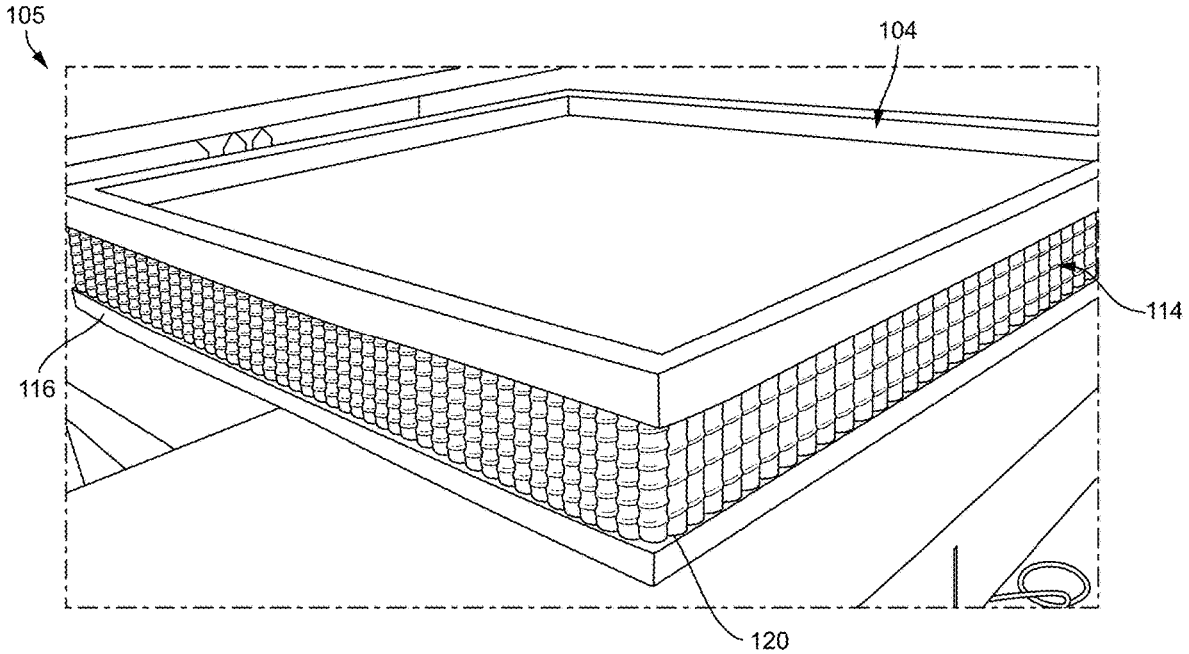
FIG. 5 is a perspective view of the encasement layer defining the top layer of a base support portion of the FIG. 1 embodiment.

In preferred embodiments of the present invention, the base support portion 105 comprises multiple layers which provide core support to the upper upholstery layers 122 when mass (e.g., a user) is positioned on the top surface of mattress 100. FIGS. 1 and 5 illustrate the base support portion 105 comprising the encasement layer 104, a support foam layer 116, and an exemplary inner-coil unit 114 comprising sequential rows and columns of coils 120, where the inner-coil unit 114 is configured below encasement layer 104 and above support foam layer 116.

Figure 6:
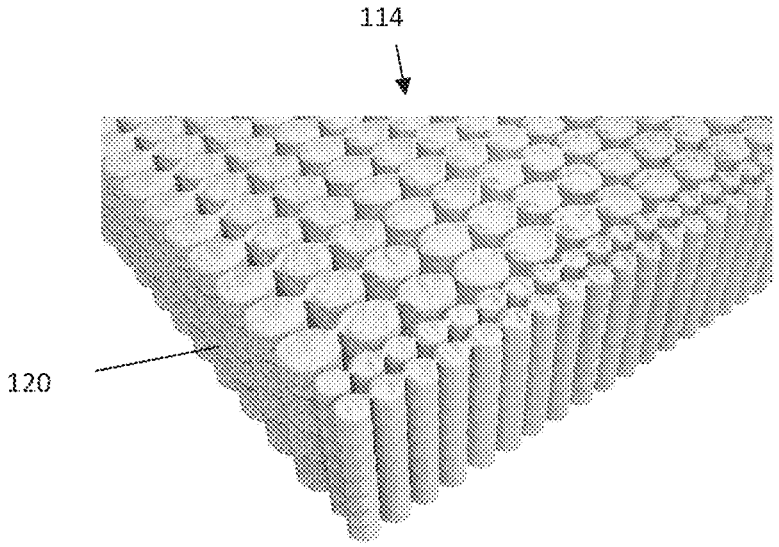
FIG. 6 is a perspective view of an exemplary inner-coil unit of the FIG. 5 embodiment.

In the embodiment shown in FIG. 1, the coils 120 are axially perpendicular relative to the encasement layer 104 and support foam layer 116. Another example of an exemplary inner-coil unit 114 having sequential rows and columns of coils 120 is shown in FIG. 6. Without limitation, one further example of an inner-coil unit 114 may be a heavy duty pocketed inner-coil unit for motion transfer support and increased airflow (e.g., to facilitate delivery), such as a QUANTUM EDGE™ pocket spring. Other exemplary embodiments may include other spring or support systems as an alternative to inner-coil unit 114.

In addition, in certain preferred embodiments, the support foam layer may comprise 2" of support foam. Other exemplary embodiments may include other thicknesses or types of support material. In the FIG. 1 embodiment, a protective cover 118 is shown at the bottom of base support portion 105. In exemplary embodiments, the protective cover 118 may or may not be part of or connected to the removable mattress top portion 101.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A mattress comprising:

a base support portion, the base support portion including a protective cover;

a first layer of support foam positioned above the protective cover; and an inner-coil unit having a plurality of coils positioned above the first layer of support foam;

an encasement layer positioned over the base support portion, comprising a foundation;

foam walls extending from the foundation; and an interchangeable segment portion, the interchangeable segment portion including a plurality of foam segments, wherein one or more of the foam segments are different with respect to another of the foam segments based on foam softness and/or foam component construct, and wherein the foam segments are configured to be rearrangeable based on user comfort preference, wherein the foam segments are contained within the walls of the encasement layer;

a mattress top portion positioned over the interchangeable segment portion; and a removable and interchangeable mattress cover integrally formed with the mattress top portion and configured to substantially surround the base support portion and the encasement layer, wherein a first portion of the mattress cover is removable without removing a second portion of the mattress cover, wherein the mattress top portion is joined to the mattress cover;

wherein the inner coil unit is substantially coextensive with both the first layer of support foam and the foundation.

2. The mattress of claim 1, wherein the walls are configured to fit a plurality of rows of the foam segments between a head portion and a toe portion of the mattress, wherein one or more columns within each row is configured to receive at least one of the foam segments.

3. The mattress of claim 2, wherein the foam segments are rectangles.

4. The mattress of claim 1, wherein the foam segments comprise foam, and foam segment softness varies in accordance with a softness classification.

5. The mattress of claim 4 further comprising: a plurality of groups of foam segments, wherein each group has a unique, specific softness classification; and each group includes one or more foam segments.

6. The mattress of claim 5, wherein five foam segments are included for each group, and wherein the walls are configured to receive ten foam pieces over five rows.

7. The mattress of claim 1, wherein the mattress cover includes a zipper to facilitate removal.

8. The mattress of claim 1, wherein the mattress cover is configured to be interchangeable with other removable protective covers, including removable protective covers that have varying softness, flexibility, heat dispersing, or health improvement characteristics.

9. The mattress of claim 1, wherein the foundation comprises a second layer of support foam.

10. The mattress of claim 1, wherein the first layer of support foam comprises 2 inches of support foam.

11. A mattress comprising:

a mattress top portion configured to be removable from the mattress;

an interchangeable segment portion positioned below the mattress top portion, the interchangeable segment portion including a plurality of foam segments, wherein one or more of the foam segments are different with respect to another of the foam segments based on foam softness and/or foam component construct, and wherein the foam segments are configured to be rearrangeable based on user comfort preference;

foam walls substantially laterally surrounding the interchangeable segment portion and extending from a foundation;

a base support portion positioned below the interchangeable segment portion, the base support portion including a layer of support foam and an inner-coil unit having a plurality of coils positioned above the layer of support foam and substantially coextensive with the layer of support foam and the foundation; and a removable and interchangeable mattress cover integrally formed with the mattress top portion and configured to substantially surround the base support portion, the foam walls, and the interchangeable segment portion, wherein a first portion of the mattress cover is removable without removing a second portion of the mattress cover, wherein the mattress top portion is joined to the mattress cover.

12. The mattress of claim 11, wherein the foundation is positioned planarly parallel to the layer of support foam.

13. The mattress of claim 12, wherein the walls extend upward from each side of a perimeter of the foundation, wherein the walls act to facilitate retention of the foam segments relative to the foundation and the mattress top portion.

14. The mattress of claim 11, wherein the plurality of coils in the inner-coil unit are above and axially perpendicular to the layer of support foam.

15. The mattress of claim 12, wherein the plurality of coils in the inner-coil unit are below and axially perpendicular to the foundation.

16. The mattress of claim 11, wherein the layer of support foam comprises 2 inches of support foam.

17. The mattress of claim 12, wherein the walls are configured to fit a plurality of rows of the foam segments between a head portion and a toe portion of the mattress, wherein one or more columns within each row is configured to receive at least one of the foam segments.

18. The mattress of claim 17, wherein the foam segments are rectangles.

19. The mattress of claim 11, wherein foam segment softness varies in accordance with a softness classification.

20. The mattress of claim 11, wherein the mattress cover includes a zipper to facilitate removal.

21. The mattress of claim 11, wherein the mattress cover is configured to be interchangeable with other removable protective covers, including removable protective covers of varying softness, flexibility, heat dispersing, or health improvement characteristics.

* * * * *